US006517680B1

(12) United States Patent
Fredlund et al.

(10) Patent No.: US 6,517,680 B1
(45) Date of Patent: Feb. 11, 2003

(54) METHOD IN CONNECTION WITH THE PRODUCTION OF PAPER OR CARDBOARD

(75) Inventors: Mats Fredlund, Karlstad (SE); Anders Moberg, Hammarö (SE); Frank Peng, Karlstad (SE); Fredrik Werner, Karlstad (SE)

(73) Assignee: Stora Kopparbergs Bergslags Aktiebolag (publ), Falun (SE)

( * ) Notice: Subject to any disclaimer, the term of this patent is extended or adjusted under 35 U.S.C. 154(b) by 0 days.

(21) Appl. No.: 09/914,017

(22) PCT Filed: Jan. 13, 2000

(86) PCT No.: PCT/SE00/00042

§ 371 (c)(1),
(2), (4) Date: Sep. 6, 2001

(87) PCT Pub. No.: WO00/50695

PCT Pub. Date: Aug. 31, 2000

(30) Foreign Application Priority Data

Feb. 22, 1999 (SE) ..... 9900607

(51) Int. Cl.[7] ..... D21F 11/00

(52) U.S. Cl. ..... 162/198; 162/130; 162/191; 162/4; 162/55

(58) Field of Search ..... 162/55, 189, 4, 162/191, 264, 123, 125, 129, 130, 132, 198; 700/127–129

(56) References Cited

U.S. PATENT DOCUMENTS 3,660,226 A * 5/1972 McKeown ..... 162/264
3,741,863 A * 6/1973 Brooks ..... 162/4
3,822,178 A * 7/1974 Von Koeppen et al. ..... 162/5
3,994,770 A * 11/1976 Lausch ..... 162/5
4,021,295 A * 5/1977 Schmaeng ..... 162/125
4,115,188 A * 9/1978 O'Brien et al. ..... 162/190
4,384,922 A * 5/1983 Stotz ..... 162/259
4,781,793 A * 11/1988 Halme ..... 162/55
5,002,633 A * 3/1991 Maxham ..... 162/5
5,324,389 A * 6/1994 Spencer ..... 162/4
6,024,834 A * 2/2000 Horton, Jr. et al. ..... 162/55

FOREIGN PATENT DOCUMENTS

| | | |
|---|---|---|
| EP | 0 653 516 | 1/1998 |
| WO | 99/03928 | 1/1999 |
| WO | 99/46442 | 9/1999 |
| WO | 99/54045 | 10/1999 |

OTHER PUBLICATIONS

Paavilainen, L., "The possibility of fractionating softwood . . . ," Appita, vol. 45, No. 5, pp. 319–326 (1992).
Lukins et al, "Broke Handling" (1994 Stock Preparation Short Course), pp. 251–265.

* cited by examiner

*Primary Examiner*—Jose A. Fortuna
(74) *Attorney, Agent, or Firm*—Nixon & Vanderhye

(57) ABSTRACT

Method for manufacturing paper or cardboard in one or more plies in order to achieve a paper or cardboard product with an even quality. The method comprises determining a fiber composition of a broke paper or cardboard waste broke, fractionating the broke; and conveying at least one fiber fraction obtained thereby to a given ply in the paper or cardboard. In this way the fractionating is controlled so that the fiber composition in the fiber fraction obtained corresponds to a fiber composition in the input paper pulp for the given ply.

14 Claims, 3 Drawing Sheets

Screen

Cyclone

METHOD IN CONNECTION WITH THE PRODUCTION OF PAPER OR CARDBOARD

TECHNICAL AREA

Figure 1:
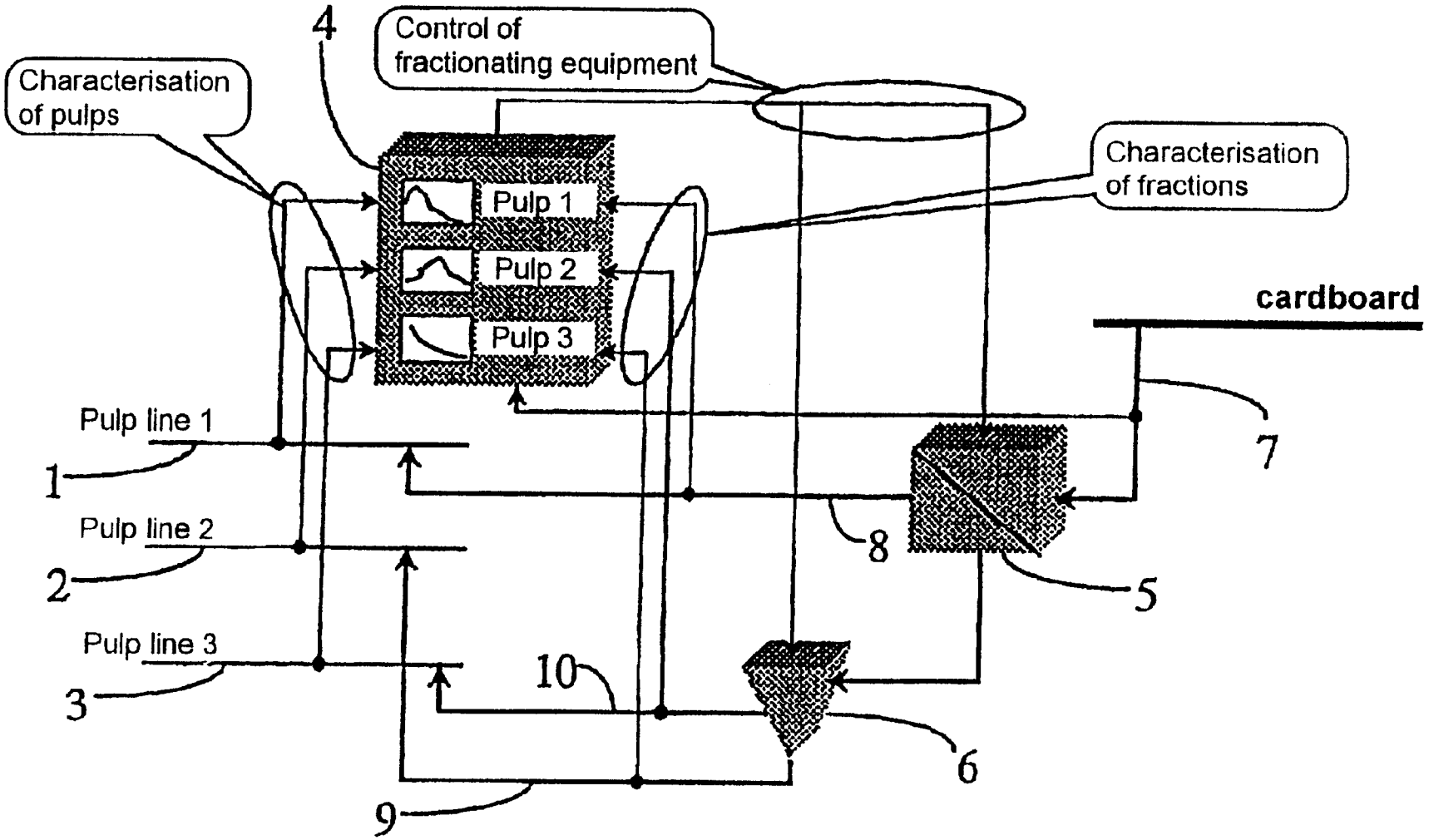

The present invention relates to a method in connection with the manufacturing of paper and cardboard. The method aims to level out quality variations and to raise the quality level through converting excess waste for manufacturing, so-called broke. The converted broke is returned in a more controlled way to the paper of cardboard, as compared to conventional techniques.

BASIS FOR THE TECHNIQUE

When manufacturing paper and cardboard from cellulose fibres, great emphasis is placed on the fibre composition for different products in order to utilise the fibres' properties in the best way. So, for example, paper and cardboard are manufactured from different stock compositions consisting of different proportions of different fibre and pulp types depending on which properties are desired in the final product. Even if a given paper or cardboard quality has a given nominal fibre composition, there is a natural variation in the fibre raw materials included as different wood species have different fibre characteristics, see Table 1, and there are also natural property variations for the fibres in wood with regard to length, width, fibre wall thickness, etc. The fibre length distribution for a Swedish softwood pulp spans from fractions of millimeters up to 6–7 mm. For birch pulp, the corresponding value is from fractions of millimeters up to approx. 3–4 mm. This means that fresh cellulose pulps demonstrate major non-homogeneities in fibre property distributions.

TABLE 1

Fibre dimensions for several different timber types

| | Southern state pine Loblolly pine, U.S.A. | | Swedish pine | | | |
|---|---|---|---|---|---|---|
| | spring wood | summer wood | spring wood | summer wood | Eucalyptus | Birch |
| Average length, mm | 3.0 | 3.5 | 2.7 | 3.0 | 1.0 | 1.1 |
| Average width, μm | 45 | 35 | 35 | 25 | 16 | 22 |
| Lumen diameter, μm | 32 | 12 | 30 | 10 | 10 | 16 |
| No. of fibres per gram timber, x107 | 1 | | 1.5 | | 13 | 8 |

Source: (Norman B. "Pappersteknik", 1991, Stockholm, Institute for Paper Engineering, Kungliga Tekniska Hogskolan)

When manufacturing paper and cardboard, there is always produced a quantity of excess material, so-called broke. This broke can comprise edge strips, widths on rolls of final product which results in that the whole machine width cannot be used to the full, second-rate quality, etc. From the mentioned examples of factors which result in broke, it is understood that the broke quantity varies over time. If one manufactures a product which complies with the quality specification and utilises the whole machine width, there will be small quantities of broke. When for some reason there are problems with complying to the quality specification, e.g. at a change of quality on the machine, and the full machine width cannot be used, the quantities of broke will become larger.

Table 2 shows a calculation example of how a varying broke quantity changes the fibre composition in a three-ply product for different broke mixes. The example is based on the broke being returned directly to the inner ply.

TABLE 2

Share of the total basis weight of fibre composition for top ply, inner ply and bottom ply in the finished product, both nominally and for the three different broke mixes.

| | | Broke mix % of total weight | | |
|---|---|---|---|---|
| | Nominal | 0 | 10 | 20 |
| Top ply (%) | 25 | 25 | 27.5 | 30 |
| Inner ply (%) | 50 | 50 | 45 | 40 |
| Bottom ply (%) | 25 | 25 | 27.5 | 30 |

All paper and cardboard qualities contain larger or smaller nominal quantities of broke. Only in cases where the whole quantity of broke can be used directly, with or without subsequent processing, quality variations due to nominal fibre composition in the paper or cardboard product is avoided, i.e. if e.g. 15% of the production results in broke when a quality which nominally should contain 15% broke of the production is manufactured at the same time. In all other cases, the broke will contribute to a quality variation by a varying fibre composition which deviates from the nominal fibre composition, due to the fact that there is a surplus of broke which must be stored, a lack of broke, stored broke of a different fibre composition compared to the quality which is presently being manufactured, etc. Broke quantities varying over time will sooner or later result in quality variations for all paper and cardboard qualities.

According to known technique, the broke can be managed in different ways depending on the broke quantity. Conventionally, the disintegrated broke is recycled, either directly, after storage in a vat/tower or after storage as a roll, to the paper or an inner ply for multi-ply paper and multi-ply cardboard. In the ideal case, the broke is broken up in water, where appropriate subsequently processed through beating or refining, and re-used in the production directly together with the originally included cellulose pulps. The varying broke quantities will however often result in broke having to be stored. This storage can be performed in two ways. One way is that the disintegrated broke is stored in a storage vat/tower after the disintegration and possible subsequent processing. The other way is to have rolls of a outclassed quality in stock, which is disintegrated and where appropriate subsequently processed for use as needed.

In the case of multi-ply paper or cardboard, it is not only varying broke quantities that cause problems. By returning the broke to an inner ply in the cardboard, the inner ply to which the disintegrated broke is added will be brought to contain pulp with fibres that originate from an outer ply. The multi-ply paper or cardboard will thereby, calculated on its total weight, contain a larger proportion than nominally of fibres of the type which is intended to be used in an outer ply of the paper or cardboard and a smaller proportion than nominally of fibres of the type intended to be used in an inner ply of the paper of cardboard, see examples in Table 2.

It is known that the fibres in a fibre flow can be fractionated by means of a screen or hydrocyclone, a screen being used to fractionate fibres primarily according to fibre length, while a hydrocyclone is used to fractionate fibres with different thicknesses and thereby different fibre flexibilities.

Studies have shown that with the aid of size fractionating (screen), it is possible to separate out a large share of short fibres from a fibre flow; Fredlund M. et al., "Förbättrade kvalitetsegenskaper hos kartong genom fraktionering", STFI-rapport TF 23, 1996, Stockholm, STFI; Grundström K-J, "STFIs silteknik höjer kvaliteten vid kommersiell drift", STFI Industrikontakt, 1995, no. 1, p. 7–8. It has also been documented that by using a hydrocyclone one can separate flexible fibres from more stiff fibres; Wood J. R. and Karnis A., "Distribution of fibre specific surface of paper-making pulps", Pulp&Paper Canada 80 (1979):4, p. 73–78, Bliss T., "Secondary fibre fractionation using centrifugal cleaners", Tappi Pulping Conference, 1984, 217 pp; Paavilainen L., "The possibility of fractionating softwood sulphate pulp according to cell wall thickness", Appita 45 (1992):5, p. 319–326. In U.S. Pat No. 5,002,633 there is described a fractionating process which aims to separate the longest fibres from short fibres, fillers, contaminants, etc., from a pulp for re-use of the longest fibres in paper manufacturing.

Moreover, it is known to combine different fractionation equipment in fractionation systems for different purposes. In U.S. Pat No. 5,403,445, recycled fibres for manufacturing of paper with more than 70% recycled fibres are fractionated, and in U.S. Pat No. 5,061,345 a series of screens is used to separate out fibres from filler. In some fractionating systems, the aim is to separate fibres with different properties in order to be able to use the fibre fractions in different plies. This is described in U.S. Pat No. 5,147,505 where the fibres in a pulp are separated according to coarseness and the rougher fibres are used in one ply and the more slender fibres are used in another ply. In EP 0653516 A1, it is mentioned in a similar way that softwood fibres are separated into a fraction with thick-walled fibres which are used in one ply and a fraction with thin-walled fibres which are used in another ply.

In Vollmer H., "Simulering av fraktioneringssystem", STFI Report TF 81, 1997, STFI, Stockholm, it is described how fractionators can be characterised for different operating conditions and how they distribute fibres with different properties in different fractions for given operating conditions. Thereby it is possible to predict the fibre property composition in the resulting fibre fractions when the operating conditions for combinations of given characterised fractionators are known, and when the fibre property composition of the input fibre flow is known.

It is also known per se to determine fibre characteristics on-line. Such systems are described e.g. in Fransson P-I., "M ätningar med STFI FiberMaster i ett kartongbruk", STFI Report TF 74, 1997, STFI, Stockholm; Karlsson H. et al., "STFI FiberMaster", STFI Report TF 70, 1997, STFL, Stockholm; Thomsson L. et al., "Uppskattning av andelen CTMP i centerskikt vid kartongtillverkning", STFI Report TF 78, 1997, Stockholm, STFI.

As a result of natural variations in the fibre raw material, varying broke quantity and varying broke composition, it is realised that it is impossible to completely avoid quality variations. Nevertheless, the variations constitute a problem in connection with increasing requirements on paper and cardboard qualities. At increasing requirements on efficient production and lower production costs, the need for optimum use of the fibre material is accentuated. This entails a need for all fibre material used for paper and cardboard manufacturing having to be used in the best way, i.e. the fibres should be used for that which they are best suited for. None of the above-mentioned documents discuss the problem of being able to manage broke for manufacturing of paper or cardboard and to be able to implement fractionation of this broke, whereupon the fractionation can be controlled so that different types of fibre in the broke can be conveyed to the most suitable ply/plies, in controlled proportions, in the paper or cardboard as produced.

DESCRIPTION OF THE INVENTION

By the present invention, a method in connection with the manufacturing of paper of cardboard is presented, whereupon excess material from the manufacturing, so-called broke, is re-used in an optimum way. Through the invention, the quality of the product may be controlled, the product's service properties may be improved and quality variations in the paper or cardboard product may be levelled out.

These and other objects are achieved by means of the method according to the invention as described below.

According to one aspect of the invention, the fibre composition for the broke is determined by on-line characterisation of one or more of the fibre length, fibre width, fibre coarseness, fibre shape and fibre flexibility parameters, while the fibre composition in the fibre fraction(s) produced is determined in the same way or is calculated, and the fibre composition in the input paper pulp for the said given ply is determined by means of intermittent characterisation of one or more of the said parameters. Moreover, the fractionation is controlled on basis of one or more of the parameters fibre composition in the input paper pulp for the said given ply, fibre composition in the broke and fibre composition in at least one of the fibre fraction(s) produced.

According to another aspect of the invention the fractionation equipment used for the fractionation is characterised intermittently in terms of fractionating effect for different fibre compositions furnished to the fractionation equipment and operating conditions, whereby operating conditions refer to the input flow to the equipment, the ratio between input flow and reject, the concentration of the input flow, or similar operating conditions, which characterisation forms the basis for the said control of the fractionation. The fractionation is controlled, preferably continuously, by means of a change of at least one of the operating conditions of the fractionation equipment, which operating conditions include the input flow to the equipment, the ratio between input flow and reject, the concentration of the input flow, or similar operating conditions.

According to another aspect of the invention, the fractionation is performed in at least two steps, whereupon a first fraction is controlled primarily to contain short fibres, and another fraction is controlled primarily to contain long fibres. The fraction with long fibres is controlled through fractionation in a second step to consist of a second fraction primarily containing long flexible fibres and a third fraction primarily containing long stiff fibres, after which the said first and/or second and/or third fraction is distributed in a desired proportion to the said given ply or several given plies at the manufacturing the paper or the cardboard.

According to a further aspect of the invention, the fractioning is performed on basis of fibre length, preferably by use of a screen, while the fractionation on basis of fibre thickness and thereby fibre flexibility is performed preferably by use of a hydrocyclone. Using the method according to the invention, the broke in existing chemical short fibre pulp (preferably in the above-mentioned first fraction), chemical long fibre pulp (preferably in the above-mentioned second fraction which contains long flexible fibres) and mechanical pulp (preferably in the above-mentioned third fraction which contains long stiff fibres) may be returned in a desired proportion to the desired ply, which gives a higher and more even quality in the product, since despite varying broke quantity and broke composition it is possible to control the product to a nominal fibre composition in the ply/plies.

In the case of multi-ply paper or cardboard, using the invention, in the broke existing

- chemical short fibres may be returned preferably to their original outer ply for which strict requirements for surface properties are imposed,
- mechanical pulp may be returned preferably to its original inner ply for which requirements are imposed for filling,
- chemical long fibres may be used optionally, after possible subsequent beating and/or fractionating, in an outer ply and/or as reinforcement in an inner ply. If the fraction containing mainly chemical long fibres undergoes further fractionation, the fine fraction can be conveyed to an outer ply and the coarse fraction can be conveyed to an inner ply as reinforcement, after beating.

The advantage of the method according to the invention is that by separating the different fibre components in the broke, a desired proportion of the fibre component can be controlled to be included in a certain ply, in a specific proportion, in the final product. In particular, on-line fibre characterisation, characterisation of fractionators and calculation of the fibre property composition of different fractions makes it possible to utilise fractionation in order to, with the aid of suitable combinations of fractionation equipment, achieve a very good possibility for optimum control of the fractionation at every individual step. Several subsequent fractionation steps may together create a fractionation system in order to tailor-make fractions with the desired fibre property composition. The desired fibre property composition in a certain fraction may thereafter be controlled in a desired proportion, on a par with the nominal fibre property composition, to be included in a desired ply. The product, i.e. the paper or cardboard, will thereby achieve a good quality and evenness in this good quality, despite the broke being included in the process.

BRIEF FIGURE DESCRIPTION

Figure 2A:
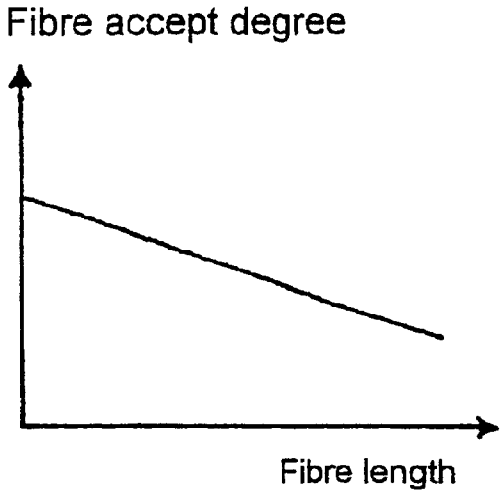
Figure 2B:
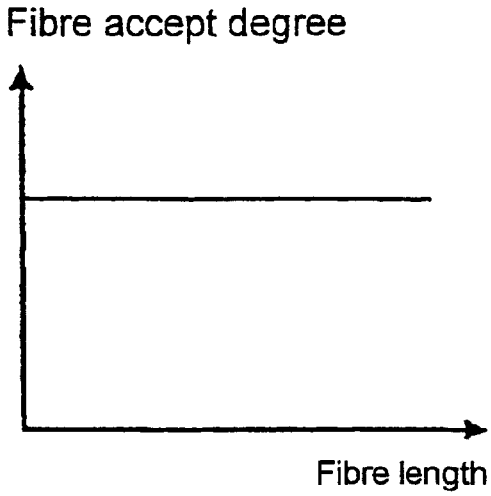
Figure 3:
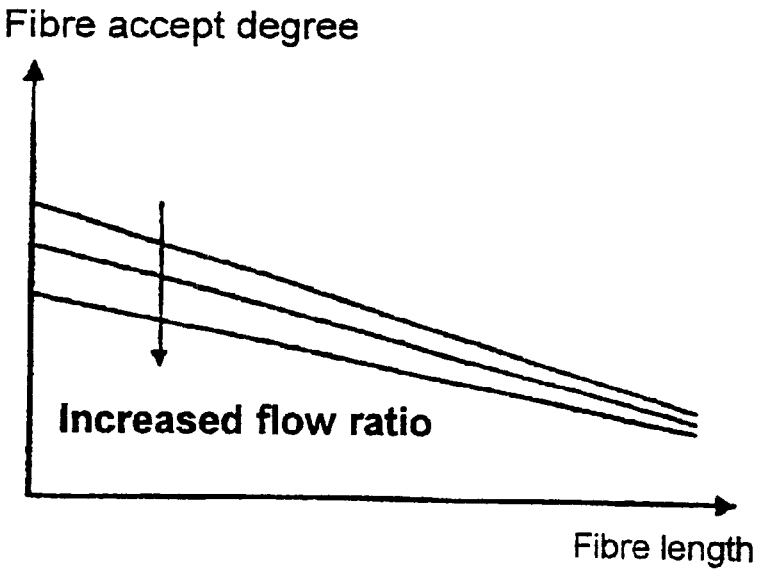
Figure 4:
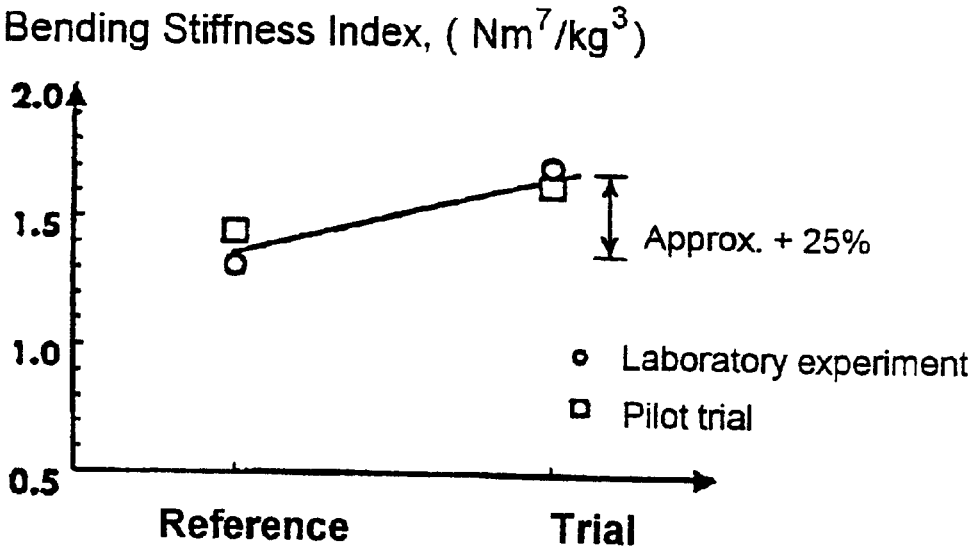

In the following the invention will be described with reference to the figures, of which:

FIG. 1 shows a simplified diagram of a proposed embodiment of the invention, FIG. 2A shows a graph that constitutes an example of fibre accept degree as a function of fibre length for a screen, FIG. 2B shows a graph that constitutes an example of fibre accept degree as a function of fibre length for a cyclone, FIG. 3 shows how the line in FIG. 2A changes in connection with an increasing ratio between reject and inject in a screen, FIG. 4 shows a result of a comparison between a bending stiffness index for a cardboard according to the invention and a reference cardboard.

DETAILED FIGURE DESCRIPTION

A proposed embodiment for the invention is shown in simplified form in FIG. 1. Based on the figure, one aspect of the invention can be described in a number of steps.

Step 1. Characterisation of Pulp

Each pulp 1, 2, 3 which is intended for a respective ply in the produced cardboard or paper is analysed with on-line fibre characterisation equipment 4. Thereby, the pulp is analysed in terms of different fibre properties/fibre compositions, e.g. fibre length, fibre width, fibre coarseness (fibre length weight), fibre form, fibre flexibility, etc. A sufficient quantity of fibres is analysed to achieve distributions with regard to the different properties for every pulp. These fibre properties/fibre compositions are used as a reference in the subsequent characterisation of the fractionator.

When the characterisation of the pulp/pulps 1, 2, 3 is done, the fibre property distribution(s) of the pulp/pulps is/are clarified.

Step 2. Characterisation of Fractionator

The fractionator or fractionators 5, 6 which is to be characterised are supplied with inject pulp which has been characterised in terms of fibre properties according to step 1. The operating conditions and equipment for the fractionator are varied systematically during the characterisation experiment. Equipment refers, for example, to the type of screen basket used if the fractionator is a screen, or the type of outlet nozzle used if the fractionator is a cyclone 6, i.e. the equipment determines design-related limitations for the fractionator. Operating conditions refer, for example, to inject flow, ratio between inject flow and reject flow, the concentration of the inject pulp, i.e. parameters which determine how a certain fractionator with a certain design is operated.

During systematic variation of the operating conditions and the equipment, the reject and accept flows are characterised in the same way as the inject flow according to step 1. If the equipment is not intended to be modified, it is sufficient to vary the operating conditions systematically. As the fibre property distributions for inject, reject and accept are determined, accept or reject curves are calculated for every operating condition of the fractionator. A diagrammatic example is shown in FIGS. 2A and 2B.

The graphs in FIGS. 2A and 2B are interpreted such that of all fibres in a given population of a certain fibre length a certain share ends up in the accept and the remaining share in the reject. For example, of fibres with length $x_1$, $y_1$% end up in the accept. Consequently, 100-$y_1$% ends up in the reject. Of fibres with length $x_2$, $y_2$% end up in the accept and 100-$y_2$% ends up in the reject. The two graphs in the figure also illustrate the fact that has been described previously, that the screen 5 fractionates according to fibre length, while the cyclone 6 fractionates according to other fibre properties (the same fibre accept degree irrespective of fibre length). At the change of an operating parameter for a screen or cyclone, the curve in the respective graph is moved as is shown in FIGS. 2A and 2B. FIG. 3 shows in a diagrammatic form what happens if the flow ratio between reject flow and inject flow in a screen is varied. An increasing flow ratio thereby leads to a reduced proportion of fibres of a certain length ending up in the accept.

When the characterisation of a given fractionator is finished, it has thus been clarified how the fractionator shall be designed and operated in order to, with a given inject with characteristic fibre property distributions, achieve a desired accept and reject in terms of fibre property distributions.

Steps 1 and 2 described above do not need to be performed continuously in the application of the invention, especially not the characterisation of the fractionator. On the other hand, it may be valuable to have available a continuous updating of the characteristics of the input pulps. The characterisation of the fractionator is relevant as long as the fractionator is intact, but needs to be repeated if the equipment is changed or if the operating parameters are changed so that they deviate from the intervals within which the different parameters were varied during the characterisation. The characterisation of input pulp may, if it is not performed continuously, be redone when the pulp production process is modified, the wood collection area is changed, major seasonal variations exist, etc.

Step 3. Characterisation of Broke

The part of the manufactured paper of cardboard which is returned as broke 7 is characterised in the same way as the input pulps in Step 1. The broke is hereupon disintegrated and, where appropriate, processed with beating or refining.

When the characterisation of the broke has been done, a basis is achieved using the fibre property distributions obtained for the broke for the way in which the fractionator should be controlled in order to achieve the desired accept and reject in terms of the fibre property distributions.

Step 4. Control of Fractionator

With the knowledge from Step 2 of how every fractionator 5, 6 works for a given fibre property distribution, the fibre property distributions of the broke 7 from Step 3 form the basis for controlling the operating conditions of the fractionator 5, 6 so that the fibre property distributions for the fractions of the broke, at a comparison with the fibre property distributions for the input pulps 1, 2, 3 are as similar as possible. As the fibre property distributions for the original input pulps 1, 2, 3 are known from Step 1, based on the fibre property distribution for the broke 7 one can calculate the fibre composition in the broke. This calculated fibre composition governs the operating parameters of the fractionator so that the operating condition will give the desired fibre separation. The fractionation is thereby controlled e.g. so that there is produced a first fraction 8 chiefly consisting of a first type of fibres, which resemble a first 1 of the input pulps, a second fraction 9 chiefly consisting of a second type of fibres, which resemble a second 2 of the input pulps, and a third fraction 10 consisting of a third type of fibres, which resemble a third 3 of the input pulps, whereupon the different fractions are controlled to a respective ply. By resemblance it is here referred to resemblance in fibre composition.

In order to verify that the control is performed in an accurate way, these fractions 8, 9, 10 are characterised 4 in the same way as the input pulps 1, 2, 3 in Step 1. The comparison between the fibre property distributions of the input pulps and the fibre property distributions of the fractions shows whether a possible adjustment of the operating conditions is necessary, which is then performed automatically. The physical control of the fractionators 5, 6 is performed by gathering data concerning fibre characterisation in a process computer where all necessary data processing is performed. Depending on the outcome of the data processing, the process computer thereafter gives signals to the process equipment, e.g. adjustments of valves, pumps, etc., in order to control the operating conditions or issue alarms if the equipment for the fractionators 5, 6 should be modified.

Steps 3 and 4 should be performed continuously during operating in order for the invention to operate in the best way.

The four steps described constitute a system for separating the broke 7 by, using knowledge of the fibre property distributions of the input pulps 1, 2, 3, (step 1) and the work method used by the fractionators 5, 6 (step 2), analysing the broke (step 3) and controlling the fractionator (step 4) so that fibre fractions are obtained from the broke which in their characteristics resemble the input pulps.

When the broke is divided into a number of fractions, whose fibre property distributions largely conform with the original pulps, the possibility is given for raising the quality level and the possibility for obtaining a more even quality by being able to return the desired, controlled quantities of the different fractions to the paper or cardboard. If it is a multi-ply product, a possibility is also given for returning a desired and controlled quantity of a certain fraction to a certain ply. If one wishes, in this way, to have a constant recycled quantity of a certain fraction to a certain ply, depending in the nominal fibre composition in the paper or cardboard, it may be required that the different fractions are subject to intermediate storage in a storage vat or a storage tower. In order to make optimum use of the fractions, it may also be advantageous subsequently to process the fractions with beating or refining. This can be done on-line if the fractions are not subject to intermediate storage, or in connection with the intermediate storage of the fractions.

Intermediate storage is especially advantageous if the paper or cardboard produced only consists of one ply. According to the invention, there is then a possibility to convey a fraction of broke from a previously manufactured paper or cardboard to this ply, which fraction exhibits a fibre composition which resembles the fibre composition in the single-ply product. The same principle is naturally also applied in connection with intermediate storage at the manufacturing of multi-ply products. Intermediate storage gives an extra possibility for achieving stability in the products. The invention is especially preferred for use in connection with the manufacturing of paper or cardboard with two or more plies.

EXAMPLE

The following example is based on results from a pilot-scale trial. During the trial, a three-ply cardboard was manufactured with a nominal basis weight of 200 g/m$^2$ on a pilot paper machine. The outer plies nominally had basis weights of 40 g/m$^2$ each, and the central ply nominally had a basis weight of 120 g/m$^2$. In the reference cardboard the outer plies consisted of a 50/50 mix of chemical short fibre/chemical long fibre and the central ply consisted of a 50/50 mix of mechanical fibres/broke. The reference cardboard was compared with a trial cardboard which had the same nominal ply basis weights and the same original pulps. The difference was that the broke had been fractionated in three steps. In the first fractionation step, which was performed in a screen, a fraction was separated out which was denoted chemical short fibre$_{broke}$. In the second fractionation step, the long fibres were separated out in a fraction of flexible fibres, chemical long fibre$_{broke}$ and a fraction of stiff fibres, mechanical fibre$_{broke}$. The chemical long fibre$_{broke}$ fraction was fractionated in a third step to an accept consisting of shorter, more slender fibres, chemical long fibre$_{broke, unbeaten}$ and a reject consisting of longer coarser fibres, chemical long fibre$_{broke, beaten}$. The reject was beaten hard to serve as a reinforcement pulp. The composition in the outer plies of the trial cardboard was 50/50 (chemical short fibre+chemical short fibre$_{broke}$)/(chemical long fibre+chemical long fibre$_{broke, unbeaten}$) and the composition of the centre ply was 55/45 mechanical fibres/(mechanical fibres$_{broke}$+chemical long fibre$_{broke, beaten}$). By returning the chemical fibres which in the reference cardboard were found in the centre ply to the outer plies in the trial cardboard, a significant bending stiffness increase was achieved as the chemical fibres removed from the centre ply could be replaced with an increased quantity of mechanical fibres. FIG. 4 shows the improved bending stiffness expressed as a bending stiffness index. The pilot-scale trial could be verified with laboratory experiments where three-ply laboratory sheets were manufactured from the same stocks as were used in the pilot trial. The trial cardboard had approx. a 25% higher bending stiffness index as compared to the reference cardboard. This means that one can manufacture a cardboard with the same bending stiffness index with 8% lower basis weight. Such a basis weight saving entails decreased raw material costs and thereby a decreased production cost.

The invention is not limited to the embodiments shown above but can be varied within the scope of the following claims. It is especially realised that the separation into fractions and the conveying of these, including any intermediate storage, may be varied in intangible ways, whereby each mill obtains a unique possibility to tailor-make its manufacturing process. When mills lie within relatively close distances from each other, it may also be profitable to transport fractions between the mills.

What is claimed is:

1. A method for manufacturing of paper or cardboard in one or more plies in order to achieve a paper or cardboard product with an even quality, comprising:

determining a fiber composition of a broke paper or cardboard waste broke;

fractionating said broke; and conveying at least one fiber fraction obtained thereby to a given ply in the paper or cardboard, whereby said fractionating is controlled so that the fiber composition in the fiber fraction obtained corresponds to a fiber composition in the input paper pulp for said given ply.

2. A method according to claim 1, wherein said fiber composition for said broke is determined by on-line characterisation of one or more of a parameter of fiber length, fiber width, fiber coarseness, fiber form and fiber flexibility, while the fiber composition in fiber fraction(s) obtained is determined in the same way or is calculated, and the fiber composition in the input paper pulp for said given ply is determined by means of intermittent characterisation of one or more of said parameters.

3. A method according to claim 1, wherein said fractionation is controlled on the basis of one or more of the parameters in the group that consists of fiber composition in the input paper pulp for said given ply, fiber composition in the broke and fiber composition in at least one of the fiber fraction(s) obtained.

4. A method according to claim 1, wherein a fractionation equipment used for the fractionation is characterized intermittently in terms of a fractionating efficiency for different input fiber compositions to the fractionation equipment and operating conditions, whereby operating conditions refer to input flow to the fractionation equipment, ratio between input flow and reject flow, concentration of input flow, which characterisation forms the basis for said control of the fractionation.

5. A method according to claim 1, wherein said fractionation is controlled by means of a change of at least one operating condition of the fractionation equipment, which operating conditions include input flow to the fractionation equipment, ratio between input flow and reject flow, concentration of input flow or similar operating conditions.

6. A method according to claim 5, wherein said fractionation is controlled continuously.

7. A method according to claim 1, wherein said broke, before fractionation, is disintegrated to a fiber suspension which is subsequently processed, where appropriate, by means of beating or refining.

8. A method according to claim 1, wherein the fractionation of the broke is performed in at least one step for the production of a first fiber fraction mainly consisting of a first type of fibers, which in fiber composition correspond to the input paper pulp for a first given ply, and a second fiber fraction mainly consisting of a second type of fibers, which in fiber composition correspond to the input paper pulp for a second given ply, whereafter said first fiber fraction is conveyed to said first ply and said second fiber fraction is conveyed to said second ply.

9. A method according to claim 8, wherein said first fiber fraction comprises shorter fibers and said second fiber fraction comprises longer fibers.

10. A method according to claim 8, wherein said first fiber fraction comprises flexible fibers and said second fiber fraction comprises stiff fibers.

11. A method according to claims 1, wherein said fractionation is performed in at least two steps, whereby a first fiber fraction comprises shorter fibers, a second fiber fraction comprises longer flexible fibers and a third fiber fraction comprises long stiff fibers, whereafter said first and/or second and/or third fraction is distributed in a desired proportion to said given ply or several given plies at the manufacturing of the paper or the cardboard.

12. A method according to claim 11, wherein the distribution of a desired proportion is performed by comparison of a calculated fiber composition in a given ply after mixing in fiber fraction(s) with a nominal fiber composition in said given ply.

13. A method according to claim 11, wherein said second fiber fraction is further beaten and/or fractionated, before being distributed in a desired proportion to one or more of said given plies.

14. A method according to claim 1, further comprising intermediate storing and, where appropriate, subsequent processing by means of beating or refining of one or more of the fiber fractions.

* * * * *